US011396706B2

(12) United States Patent
Kulko et al.

(10) Patent No.: US 11,396,706 B2
(45) Date of Patent: Jul. 26, 2022

(54) ELECTROLESS COPPER OR COPPER ALLOY PLATING BATH AND METHOD FOR PLATING

(71) Applicant: Atotech Deutschland GmbH, Berlin (DE)

(72) Inventors: Roman-David Kulko, Berlin (DE); Sebastian Zarwell, Berlin (DE); Kilian Klaeden, Berlin (DE); Anna Peter, Berlin (DE); Birgit Beck, Berlin (DE)

(73) Assignee: Atotech Deutschland GmbH, Berlin (DE)

( * ) Notice: Subject to any disclaimer, the term of this patent is extended or adjusted under 35 U.S.C. 154(b) by 0 days.

(21) Appl. No.: 16/973,068

(22) PCT Filed: Jun. 5, 2019

(86) PCT No.: PCT/EP2019/064616
§ 371 (c)(1),
(2) Date: Dec. 8, 2020

(87) PCT Pub. No.: WO2019/234085
PCT Pub. Date: Dec. 12, 2019

(65) Prior Publication Data

US 2021/0246559 A1 Aug. 12, 2021

(30) Foreign Application Priority Data

Jun. 8, 2018 (EP) ..... 18176836

(51) Int. Cl.
*C23C 18/40* (2006.01)
*C23C 18/16* (2006.01)
*C23C 18/48* (2006.01)
*C25D 3/38* (2006.01)

(52) U.S. Cl.
CPC ..... *C23C 18/40* (2013.01); *C23C 18/1653* (2013.01); *C23C 18/48* (2013.01); *C25D 3/38* (2013.01)

(58) Field of Classification Search
CPC ..... C23C 18/40; C23C 18/1653; C23C 18/48; C23C 18/405; C25D 3/38
See application file for complete search history.

(56) References Cited

U.S. PATENT DOCUMENTS 4,617,205 A 10/1986 Darken
4,629,636 A 12/1986 Courduvelis et al.
7,220,296 B1 5/2007 Chowdhury et al.
7,297,190 B1 * 11/2007 Dordi ..... C23C 18/40 106/1.23
8,394,289 B2 3/2013 Satou et al.
9,909,216 B2 3/2018 Brunner et al.
10,767,275 B2 9/2020 Brunner et al.
2004/0154929 A1 8/2004 Grunwald
2005/0175780 A1 8/2005 Sparing et al.
2008/0038450 A1 2/2008 Poole et al.
2008/0223253 A1 9/2008 Song et al.
2012/0213914 A1 8/2012 Ivanov et al.
2014/0242264 A1 8/2014 Stenhauser et al.
2015/0024139 A1 * 1/2015 Yoshida ..... C23C 18/1633 427/443.1
2015/0060132 A1 * 3/2015 Murakawa ..... H05K 9/0086 174/388

(Continued)

FOREIGN PATENT DOCUMENTS

CN 103397316 A * 11/2013
EP 1001052 B1 5/2000

(Continued)

OTHER PUBLICATIONS

PCT/EP2019/064616; PCT International Search Report and Written Opinion of the International Searching Authority dated Jul. 5, 2019.

*Primary Examiner* — Dah-Wei D. Yuan
*Assistant Examiner* — Nga Leung V Law
(74) *Attorney, Agent, or Firm* — Renner, Otto, Boisselle & Sklar, LLP

(57) ABSTRACT

An electroless copper plating bath for depositing a copper or copper alloy layer on a surface of a substrate, including copper ions; a reducing agent; a complexing agent for copper ions; wherein the bath further includes at least one compound according to formula (1):

(1)

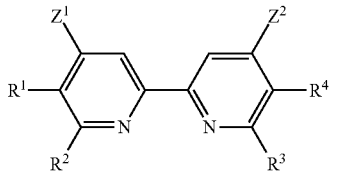

in which $Z^1$ and $Z^2$ are independently selected from the group consisting of hydrogen; carboxylic acid; carboxylate; sulfonic acid; sulfonate; carboxamide; nitrile; nitro; trialkylammonium; 2-carboxyvinyl; 2-vinylcarboxylate; 2-(trialkylammonium)vinyl; hydroxamic acid; and oxime; provided at least one of $Z^1$ and $Z^2$ is not hydrogen;

and in which $R^1$, $R^2$, $R^3$ and $R^4$ are:

i. $R^1$, $R^2$, $R^3$ and $R^4$ are hydrogen; or ii. $R^1$ with $R^2$ form together an aromatic ring, $R^3$ and $R^4$ are hydrogen; or iii. $R^3$ with $R^4$ form together an aromatic ring, $R^1$ and $R^2$ are hydrogen; or iv. both $R^1$ with $R^2$ and $R^3$ with $R^4$ form together an aromatic ring, respectively.

14 Claims, No Drawings

(56) References Cited

U.S. PATENT DOCUMENTS

| | | | |
|---|---|---|---|
| 2016/0145745 | A1 | 5/2016 | Wu et al. |
| 2016/0273112 | A1 | 9/2016 | Bruning et al. |

FOREIGN PATENT DOCUMENTS

| | | | | |
|---|---|---|---|---|
| JP | 2004211131 | A | * | 7/2004 |
| JP | 2004211131 | A | | 7/2004 |

* cited by examiner

ELECTROLESS COPPER OR COPPER ALLOY PLATING BATH AND METHOD FOR PLATING

The present application is a U.S. National Stage Application based on and claiming benefit and priority under 35 U.S.C. § 371 of International Application No. PCT/EP2019/064616, filed 5 Jun. 2019, which in turn claims benefit of and priority to European Application No. 18176836.7 filed 8 Jun. 2018, the entirety of both of which is hereby incorporated herein by reference.

FIELD OF THE INVENTION

The present invention concerns an electroless copper plating bath for depositing at least a copper or copper alloy layer on a surface of a substrate, a method for depositing at least a copper or copper alloy layer on a surface of a substrate utilizing said electroless plating bath, a layer system comprising a copper or copper alloy layer deposited from the inventive electroless copper plating bath, and a kit-of-parts for providing the inventive electroless copper plating bath.

BACKGROUND OF THE INVENTION

The wet-chemical deposition of metal layers onto surfaces has a long tradition in the art. This wet-chemical deposition can be achieved by means of electrolytic or electroless plating of metals. These methods are of high importance in the electronics industry and, among other applications, are used in the manufacturing of printed circuit boards, semiconductor devices and similar goods. The most important metal in this regard is copper as it is used for the build-up of the conductive lines forming the circuitry in said goods.

Wet-chemical deposition of metals can be roughly divided into electrolytic and electroless plating processes. Electroless plating is the controlled autocatalytic deposition of a continuous film of metal without the assistance of an external supply of electrons. Contrary to that, electrolytic plating requires such an external supply of electrons. Non-metallic surfaces may be pretreated to make them receptive or catalytic for deposition. All or selected portions of a surface may suitably be pretreated. The main components of electroless copper plating baths are a copper salt, a complexing agent, a reducing agent, and, as optional ingredients as for example stabilizing agents. Complexing agents (also called chelating agents in the art) are used to chelate the metal being deposited and prevent the metal from being precipitated from solution (i.e. as the hydroxide and the like). Chelating metal renders the metal available to the reducing agent which converts the metal ions to its metallic form. A further form of metal deposition is immersion plating. Immersion plating is another deposition of metal without the assistance of an external supply of electrons and without chemical reducing agent. The mechanism relies on the substitution of metals from an underlying substrate for metal ions present in the immersion plating solution. Due to this mechanism, only very thin metal layers can be obtained on metal layers less noble than the metal to be deposited. In the context of the present invention electroless plating is to be understood as autocatalytic deposition with the aid of a chemical reducing agent (referred to a "reducing agent" herein).

Even though these plating techniques have been used for many decades, there are still many technical challenges unsolved. It is a common procedure in the art to first form a copper or copper alloy layer by an electroless plating process followed by a thickening of said layer by electrolytic copper plating. The inventors found out that the properties of the subsequently formed electrolytic copper or copper alloy layer on the electroless copper or copper alloy layer are largely influenced by the latter. One unresolved challenge in the art of electroless copper plating is the formation of deposits having a high gloss which show little tendency for ruptures and breakages (upon application of mechanical stress). And further, it is of great interest and still not satisfactorily solved that the subsequently formed electrolytic layers (on the electrolessly deposited copper or copper alloy layers) are of high mechanical stability against ruptures or breakages and show a high gloss. This is even more pronounced if flexible materials are used as substrate, and mechanical stress is quickly transferred to the copper lines if the material is bent. Many copper or copper alloy layers formed from prior art solutions exhibit poor mechanical flexibility and break too fast when subjected to mechanical stress, potentially rendering the complete product containing such damaged layer dysfunctional.

Another aspect also connected to the issues outlined above concerns the stabilizing agents (also referred to as stabilizers in the art) in the plating baths. Stabilizing agents are compounds that stabilize the plating bath against unwanted plate-out (also called "outplating") in the bulk solution. The term "plate-out" means unwanted and/or uncontrolled deposition of copper, for example on the bottom of a reaction vessel or on other surfaces. Generally, electroless copper plating baths without stabilizing agent lack sufficient stability and they become dysfunctional too quickly to be of commercial use although copper layers obtained from such unstabilized baths can be very glossy. While many stabilizing agents are known for electroless copper plating bath in the art, they all have certain undesirable side-effects. For example, serious health and environmental concerns are attributed with thiourea and its derivatives as well as with cyanides. Many nitrogen-containing stabilizing agents allow for very small working concentration windows which makes them difficult to use and even more disadvantageously, they tend to reduce the gloss and smoothness of copper or copper alloy layers (both of the electrolessly deposited copper or copper alloy layer and the subsequently applied electrolytic copper or copper alloy layer formed on the first-mentioned), particularly when used in concentrations in the baths to allow for sufficient lifetimes of the baths. This is very problematic in the electronic industry for a multitude of reasons. To name but a few, the automatic optical inspections used in the manufacturing processes are tuned to very glossy copper layers. It may thus result in scrap production if the copper or copper alloy layers are too dull or very tedious adaptations of the inspection systems might be required in each case. Further, smooth layers are desirable because dull surfaces may result in weak surface distribution, delamination defects after lamination and shorts after structuring by photolithography. This can drastically reduce the production yield. For these reasons, new stabilizing agents are needed for electroless copper plating baths.

US 2004/0154929 A1 discloses a method and composition for improving the deposition plating rate of electroless copper. The composition comprises copper ions, a complexing agent for $Cu^{++}$ ions, a complexing agent for $Cu^{+}$ ions, a reducing agent capable of reducing copper ions to metallic copper and hydroxide ions to a pH of at least 10.

US 2005/0175780 A1 refers a to an acidic solution for silver deposition through charge transfer reaction and to a method for silver layer deposition on metal surfaces through charge transfer reaction, more specifically for manufacturing printed circuit boards and other circuit carriers. The solution comprises silver ions and at least one Cu(I) complexing agent.

U.S. Pat. No. 7,297,190 B1 refers to an electroless copper plating solution comprising an aqueous copper salt component, an aqueous cobalt salt component, a polyamine-based complexing agent, a chemical brightener component, a halide component, and a pH-modifying substance in an amount sufficient to make the electroless copper plating solution acidic.

OBJECTIVE OF THE PRESENT INVENTION

It is therefore an objective of the present invention to overcome the shortcomings of the prior art.

It is another objective underlying the present invention to provide an electroless copper plating bath comprising an improved stablizing agent.

It is yet another objective of the present invention to provide an electroless copper plating bath allowing for glossy copper or copper alloy layers. In one aspect this gloss requirement also applies to an electrolytically deposited copper or copper alloy layer on layers from an electroless bath.

It is a further objective of the present invention to provide an electroless copper plating bath having a sufficient lifetime, e.g. against undesired decomposition such as outplating. Sufficient lifetime preferably means in this context that the plating bath shall be stable and functional (i.e. suitable for plating purposes) for at least 7 days.

It is still a further objective of the present invention to provide an electroless copper plating bath allowing for copper or copper alloy layer having sufficient adhesion to the underlying substrate.

SUMMARY OF THE INVENTION

The objectives underlying the present invention are solved by the first aspect of the present invention which is an electroless copper plating bath according to the invention for depositing a copper or copper alloy layer on a surface of a substrate, comprising a) copper ions;

b) at least one reducing agent suitable for reducing copper ions to metallic copper; and c) at least one complexing agent for copper ions;

characterized in that the electroless copper plating bath comprises d) at least one compound according to formula (1):

(1)

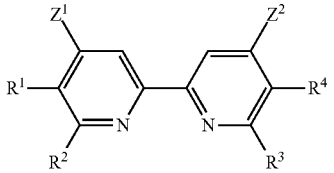

wherein $Z^1$ and $Z^2$ are independently selected from the group consisting of hydrogen; carboxylic acid group; carboxylate group; sulfonic acid group; sulfonate group; substituted or non-substituted carboxamide group; nitrile group; nitro group; substituted or non-substituted trialkylammonium group; substituted or non-substituted 2-carboxyvinyl group; substituted or non-substituted 2-vinylcarboxylate group; substituted or non-substituted 2-(trialkylammonium)vinyl group; substituted or non-substituted hydroxamic acid group; and substituted or non-substituted oxime group;

with the proviso that at least one of $Z^1$ and $Z^2$ is not hydrogen;

and wherein $R^1$, $R^2$, $R^3$ and $R^4$ are defined as follows:

i. $R^1$, $R^2$, $R^3$ and $R^4$ are hydrogen; or ii. $R^1$ with $R^2$ are forming together a substituted or non-substituted aromatic ring moiety, $R^3$ and $R^4$ are hydrogen; or iii. $R^3$ with $R^4$ are forming together a substituted or non-substituted aromatic ring moiety, $R^1$ and $R^2$ are hydrogen; or iv. $R^1$ with $R^2$ as well as $R^3$ with $R^4$ are forming together a substituted or non-substituted aromatic ring moiety, respectively.

The objectives underlying the present invention are further solved by the second aspect of the present invention being a method for depositing at least a copper or copper alloy layer on a surface of a substrate according to the invention, comprising, in this order, the method steps:

(i) providing the substrate with the surface;

(ii) contacting at least a portion of the surface of the substrate with the inventive electroless copper plating bath;

and thereby depositing a copper or copper alloy layer onto the at least one portion of the surface of the substrate.

In a third aspect, the present invention is directed to a preferred method thereof, wherein a further method step (iii) is comprised after method step (ii), which is defined as follows:

(iii) depositing a copper or copper alloy layer from an electrolytic copper plating bath (as described in claim 13).

In a fourth aspect, the present invention concerns a layer system as defined by claim 14.

In a fifth aspect, the present invention relates to a kit-of-parts for providing the inventive electroless copper plating bath.

Preferred embodiments of the present invention are described in further dependent claims and in this specification hereinafter.

DETAILED DESCRIPTION OF THE INVENTION

Percentages throughout this specification are weight-percentages (wt.-%) unless stated otherwise. Concentrations given in this specification refer to the volume or mass of the entire solutions/compositions unless stated otherwise. The terms "deposition" and "plating" are used interchangeably herein. Also, "layer" and "deposit" are also used synonymously in this specification. The terms "substitution" and "functionalization" are used interchangeably in this specification.

The term "alkyl group" according to the present invention comprises branched or unbranched alkyl groups comprising cyclic and/or non-cyclic structural elements, wherein cyclic structural elements of the alkyl groups naturally require at least three carbon atoms. C1-CX-alkyl group in this specification and in the claims refers to alkyl groups having 1 to X carbon atoms (X being an integer). C1-C8-alkyl group for example includes, among others, methyl, ethyl, n-propyl, iso-propyl, n-butyl, iso-butyl, sec-butyl, tert-butyl, n-pentyl, iso-pentyl, sec-pentyl, tert-pentyl, neo-pentyl, hexyl, heptyl and octyl. Substituted alkyl groups may theoretically be obtained by replacing at least one hydrogen by a functional group. Unless stated otherwise, alkyl groups are preferably selected from substituted or unsubstituted C1-C8-alkyl groups, more preferably from substituted or unsubstituted C1-C4-alkyl groups because of their improved solubility in water.

The term "aryl group" according to the present invention refers to ring-shaped aromatic hydrocarbon residues, for example phenyl or naphtyl where individual ring carbon atoms can be replaced by N, O and/or S, as for example in benzothiazolyl. Furthermore, aryl groups are optionally substituted by replacing a hydrogen atom in each case by a functional group. The term C5-CX-aryl group refers to aryl groups having 5 to X carbon atoms (wherein one or more carbon atoms are optionally replaced by N, O and/or S (without changing the number of 5 to X) and X is an integer) in the ring-shaped aromatic group. Unless stated otherwise, aryl group are preferably selected from substituted or unsubstituted C5-C10-aryl groups, more preferably from substituted or unsubstituted C5-C6-aryl groups because of their improved solubility in water. Naturally, a C5-aryl group requires the replacement of at least one carbon atom for a heteroatom capable of donating electrons such as nitrogen, sulfur or oxygen.

The term "combination of alkyl group(s) and aryl group(s)" according to the present invention refers to moieties comprising at least one alkyl group and at least one aryl group such as tolyl ($—C_6H_4—CH_3$) and benzyl ($—CH_2-C_6H_5$).

Unless stated otherwise, above-defined groups are substituted or unsubstituted. Functional groups as substituents are preferably selected from the group consisting of oxo (=O), hydroxyl (—OH), amino ($—NH_2$), carbonyl (—CHO) and carboxyl ('$CO_2H$) to improve the solubility of the relevant compounds in polar solvents such as water, the substituent is more preferably hydroxyl. In one embodiment of the present invention, the groups are preferably unsubstituted unless stated otherwise hereinafter. Oxo is not to be mistaken for oxy (—O—) which is usually an oxygen atom of an ether moiety (and thus placed between two carbon atoms).

If more than one substituent is to be selected from a certain group, each substituent is selected independently from each other unless stated otherwise herein. The embodiments described hereinafter can be combined without restraints unless this is technically not feasible or specifically excluded. Preferred embodiments described for one aspect of the present invention are applicable mutatis mutandis to all the other aspects of the present invention unless stated otherwise herein.

The inventive electroless copper plating bath comprises copper ions. The copper ions may be included in the inventive electroless copper plating bath by any (water soluble) copper salt or other (water soluble) copper compound suitable to liberate copper ions in a liquid medium such as an aqueous solution. Preferably, the copper ions are added as copper sulfate, copper chloride, copper nitrate, copper acetate, copper methanesulfonate ($(CH_3O_3S)_2Cu$), one or more hydrates of any of the aforementioned or mixtures of the aforementioned. The concentration of the copper ions in the inventive electroless copper plating bath preferably ranges from 0.1 to 20 g/L, more preferably from 1 to 10 g/L, even more preferably from 2 to 5 g/L.

The inventive electroless copper plating bath comprises at least one reducing agent suitable for reducing copper ions to metallic copper. Said at least one reducing agent is thus capable of converting copper(I)-ions and/or copper(II)-ions present in the inventive electroless copper plating bath to elemental copper. The reducing agent is preferably selected from the group consisting of formaldehyde; paraformaldehyde; glyoxylic acid; sources of glyoxylic acid; aminoboranes such as dimethylaminoborane; alkali borohydrides such as $NaBH_4$, $KBH_4$; hydrazine; polysaccharides; sugars such as glucose; hypophosphoric acid; glycolic acid; formic acid; ascorbic acid; salts and mixtures of any of the aforementioned. If the inventive electroless copper plating bath contains more than one reducing agent, it is preferable that the further reducing agent is an agent that acts as reducing agent but cannot be used as the sole reducing agent (cf. U.S. Pat. No. 7,220,296, col. 4, I. 20-43 and 54-62). Such further reducing agent is in this sense also called an "enhancer".

The term "source of glyoxylic acid" encompasses glyoxylic acid and all compounds that can be converted to glyoxylic acid in liquid media such as an aqueous solution. In aqueous solution the aldehyde containing acid is in equilibrium with its hydrate. A suitable source of glyoxylic acid is dihaloacetic acid, such as dichloroacetic acid, which will hydrolyze in a liquid medium such as an aqueous medium to the hydrate of glyoxylic acid. An alternative source of glyoxylic acid is the bisulfite adduct. The bisulfite adduct may be added to the composition or formed in situ. The bisulfite adduct may be made from glyoxylate and either bisulfite, sulfite or metabisulfite.

The concentration of the at least one reducing agent in the inventive electroless copper plating bath preferably ranges from 0.02 to 0.3 mol/L, more preferably from 0.054 to 0.2 mol/L, even more preferably from 0.1 to 0.2 mol/L. In case more than one reducing agent is comprised in the inventive electroless copper plating bath, the sum of concentrations of all reducing agents is in above ranges.

The inventive electroless copper plating bath comprises at least one complexing agent for copper ions. Such complexing agent is sometimes referred to as chelating agent in the art. The at least one complexing agent is capable of forming a coordination compound with copper(I)-ions and/or copper (II)-ions present in the inventive electroless copper plating bath. Preferable complexing agents are sugar alcohols such as xylitol, mannitol and sorbitol; alkanol amines such as triethanol amine; hydroxycarboxylic acids such as lactic acid, citric acid and tartaric acid; aminophosphonic acids and aminopolyphosphonic acids such as aminotris(methylphosphonic acid); aminocarboxylic acids such as oligoamino monosuccinic acid, polyamino monosuccinic acid including oligoamino disuccinic acids like ethylenediamine-N,N'-disuccinic acid, polyamino disuccinic acids, aminopolycarboxylic acids such as nitrilotriacetic acid, ethylenediamine tetraacetic acid (EDTA), N'-(2-hydroxyethyl)-ethylene diamine-N,N,N'-triacetic acid (HEDTA), cyclohexanediamine tetraacetic acid, diethylenetriamine pentaacetic acid, and tetrakis-(2-hydroxypropyl)-ethylenediamine and N,N,N',N'-tetrakis(2-hydroxyethyl) ethylenediamine, salts and mixtures of any of the aforementioned.

The at least one complexing agent is more preferably selected from the group consisting of xylitol; tartaric acid; ethylenediamine tetraacetic acid (EDTA); N'-(2-hydroxyethyl)-ethylene diamine-N,N,N'-triacetic acid (HEDTA); tetrakis-(2-hydroxypropyl)-ethylenediamine; salts and mixtures of any of the aforementioned.

The concentration of the at least one complexing agent in inventive electroless copper plating preferably ranges from 0.004 mol/L to 1.5 mol/L, more preferably from 0.02 mol/L to 0.6 mol/L, even more preferably from 0.04 mol/L to 0.4 mol/L. In case more than one complexing agent is used, the concentration of all complexing agents lies preferably in above-defined ranges.

In one embodiment of the invention, the molar ratio of the at least one complexing agent (which means in this connection the total amount of all complexing agent(s)) to copper ions ranges from 1.3:1 to 5:1, more preferably 2:1 to 5:1. This embodiment is particularly advantageous if the inventive electroless copper plating bath is agitated during deposition, preferably agitated with a gas such as air, and/or when a further reducing agent (also called "enhancer") is used in addition to a first reducing agent such as glyoxylic acid or formaldehyde, wherein the further reducing agent is preferably selected from glycolic acid, hypophosphoric acid, or formic acid, most preferably glycolic acid.

The inventive electroless copper plating bath comprises at least one compound according to formula (1):

(1)

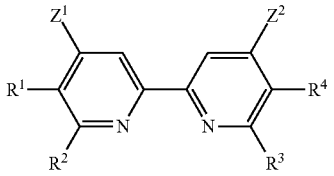

The compound according to formula (1) comprises two pyridine rings bound to each other in the 2- and 2'-position, respectively, relative to the nitrogen atoms in the rings. The at least one compound according to formula (1) acts inter alia as stabilizing agent in the inventive electroless copper plating bath. It thus improves the lifetime of the bath by reducing the risk of bath decomposition and/or plate-out. It further acts as gloss improving agent and improves inter alia the gloss of the copper or copper alloy layer formed from the electroless copper plating bath (compared for example to other known stabilizing agents) and also beneficially affects the gloss of a subsequently applied electrolytic copper or copper alloy layer formed on the first-mentioned layer.

It is a further advantage of the present invention that the compound according to formula (1) exhibits a low or no toxicity at all. It is thus possible to formulate an electroless copper plating bath which is less toxic compared to many known baths in the art.

In the compound according to formula (1), $Z^1$ and $Z^2$ are independently selected from the group consisting of

- hydrogen (—H);
- carboxylic acid group (—$CO_2H$);
- carboxylate group —$CO_2M^1$ wherein $M^1$ is a suitable counterion other than hydrogen such as a metal ion including an alkaline metal ion, an earth alkaline metal ion and a radical forming cation such as ammonium; preferably, $M^1$ is an alkaline metal ion such as lithium, sodium or potassium);
- sulfonic acid group (—$SO_3H$);
- sulfonate group (—$SO_3M^2$ wherein $M^2$ is a suitable counterion other than hydrogen such as metal ion including an alkaline metal ion, an earth alkaline metal ion and a radical forming cation such as ammonium; preferably, $M^2$ is an alkaline metal ion such as lithium, sodium or potassium);
- substituted or non-substituted carboxamide group (—$CO_2NR_2{}^1$ wherein each $R^1$ is independently a substituted or non-substituted alkyl group or hydrogen, preferably hydrogen);
- nitrile group (—C≡N);
- nitro group (—$NO_2$);
- substituted or non-substituted trialkylammonium group (—$N^+R_3{}^2$ wherein each $R^2$ is independently an substituted or non-substituted alkyl group; preferably, each $R^2$ is a C1-C4-alkyl group; more preferably, each $R^2$ is a C1-C2-alkyl group);
- substituted or non-substituted 2-carboxyvinyl group (—C($R^5$)═C($R^4$)—$CO_2H$ wherein $R^3$ and $R^4$ are independently a substituted or non-substituted alkyl group or hydrogen, preferably hydrogen);
- substituted or non-substituted 2-vinylcarboxylate group (—C($R^5$)═C($R^6$)—$CO_2M^3$ wherein $M^3$ is a suitable counterion other than hydrogen such as a metal ion including an alkaline metal ion, an earth alkaline metal ion and a radical forming cation such as ammonium; preferably, $M^3$ is an alkaline metal ion such as lithium, sodium or potassium; and wherein $R^5$ and $R^6$ are independently a substituted or non-substituted alkyl group or hydrogen, preferably hydrogen);
- substituted or non-substituted 2-(trialkylammonium)vinyl group (—C($R^7$)═C($R^8$)—$N^+R_3{}^9$ wherein $R^5$ and $R^6$ are independently a substituted or non-substituted alkyl group or hydrogen, preferably hydrogen; and each $R^9$ is independently an alkyl group; preferably, each $R^9$ is a C1-C4-alkyl group; more preferably, each $R^9$ is a C1-C2-alkyl group);
- substituted or non-substituted hydroxamic acid group)(—C((O)—N($R^{10}$)—OH wherein $R^{10}$ is selected from the group consisting of alkyl group, aryl group and combinations thereof); and
- substituted or non-substituted oxime group (—C($R^{11}$)═N—OH wherein $R^{11}$ is selected from the group consisting of hydrogen, alkyl group, aryl group and combinations of alkyl and aryl)

with the proviso that at least one of $Z^1$ and $Z^2$ is not hydrogen. The inventors have found that if both $Z^1$ and $Z^2$ are hydrogen, the gloss of copper layers is impaired, the coverage of a substrate to be plated with copper and the plating rate of the bath are decreased (see tables 2 to 4).

Preferable substitutions of above groups are described inter alia above. In one embodiment of the invention, the named groups are non-substituted.

Other theoretically applicable residues for $Z^1$ and $Z^2$ such as halides, alkyl groups and alkoxy groups were found by the inventors to significantly reduce the plating rate of the electroless plating bath and to impair the gloss of the deposits formed.

Preferably, $Z^1$ and $Z^2$ are independently selected from the group consisting of hydrogen; carboxylic acid group; carboxylate group; sulfonic acid group; sulfonate group; nitrile group; nitro group; substituted or non-substituted trialkylammonium group; substituted or non-substituted 2-carboxyvinyl group; and substituted or non-substituted 2-(trialkylammonium)vinyl group.

More preferably, $Z^1$ and $Z^2$ are independently selected from the group consisting of hydrogen; carboxylic acid group; carboxylate group; sulfonic acid group; sulfonate group; substituted or non-substituted trialkylammonium group; substituted or non-substituted 2-carboxyvinyl group; and substituted or non-substituted 2-(trialkylammonium) vinyl group.

Even more preferably, $Z^1$ and $Z^2$ are independently selected from the group consisting of hydrogen; carboxylic acid group; carboxylate group; sulfonic acid group; and sulfonate group.

Yet even more preferably, $Z^1$ and $Z^2$ are independently selected from the group consisting of hydrogen, carboxylic acid group and carboxylate group.

In one embodiment of the invention, $Z^1$ and $Z^2$ are the same.

In one embodiment of the invention, neither $Z^1$ nor $Z^2$ is hydrogen.

The outlined preferences for selecting $Z^1$ and $Z^2$ are based on the findings of the inventors that the objectives underlying the present invention are particularly well solved when employing the preferred selections outlined above such as the formation of glossy deposits, both of the deposits formed directly from the inventive electroless copper plating bath and of subsequently applied electrolytic copper or copper alloy layer formed. Further, a sufficiently high plating rate can be obtained.

$R^1$, $R^2$, $R^3$ and $R^4$ are defined as follows:

i. $R^1$, $R^2$, $R^3$ and $R^4$ are hydrogen; or ii. $R^1$ with $R^2$ are forming together a substituted or non-substituted aromatic ring moiety, $R^3$ and $R^4$ are hydrogen; or iii. $R^3$ with $R^4$ are forming together a substituted or non-substituted aromatic ring moiety, $R^1$ and $R^2$ are hydrogen; or iv. $R^1$ with $R^2$ as well as $R^3$ with $R^4$ are forming together a substituted or non-substituted aromatic ring moiety, respectively.

Such aromatic ring moieties are for example o-phenylene (benzene-1,2-diyl). It is also possible that one or more of the carbon atoms forming the aromatic ring may be substituted by heteroatoms such as oxygen, nitrogen or sulfur. In case of ii, iii, or iv for $R^1$, $R^2$, $R^3$ and $R^4$, the aromatic ring moieties are annulated to the respective pyridine ring of the compound according to formula (1) in the 5- and 6-position and/or 5'- and 6'-position respectively relative to the nitrogen atoms of the pyridine rings. Further, both pyridine rings comprise $Z^1$ and $Z^2$ in the 4- and 4'-position, respectively, relative to the nitrogen atoms.

In one embodiment of the invention, the compound according to formula (1) is represented by formula (2):

(2)

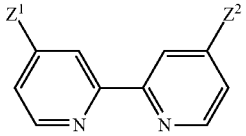

wherein $Z^1$ and $Z^2$ are selected from the groups outlined hereinbefore. In this embodiment, the compound according to formula (1) does neither comprise a substituted or non-substituted aromatic ring moiety (apart from the depicted pyridine rings). All residues $R^1$, $R^2$, $R^3$ and $R^4$ are hydrogen (case i).

In one of the cases ii, iii, or iv for $R^1$, $R^2$, $R^3$ and $R^4$ the compound according to formula (1) can preferably be represented by one of formulae (3a) to (3c):

(3a)

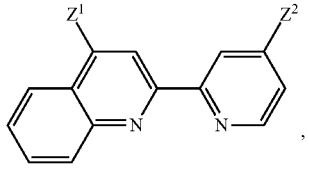

(3b)

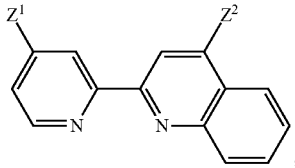

and (3c)

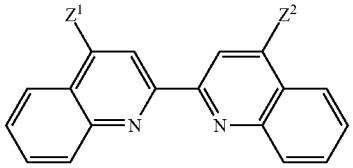

wherein $Z^1$ and $Z^2$ are selected from the groups outlined hereinbefore.

The concentration of the at least one compound according to formula (1) in the inventive electroless copper plating bath preferably ranges from $1.0*10^{-6}$ mol/L (1 μmol/L) to $5.0*10^{-53}$ mol/L (5 mmol/L), more preferably from $4.0*10^{-6}$ mol/L (4 μmol/L) to $4*10^{-3}$ mol/L (4 mmol/L), even more preferably from $2.0*10^{-5}$ mol/L (20 μmol/L) to $6.5*10^{-4}$ mol/L (650 μmol/L). If the inventive electroless copper plating bath comprises more than one compound according to formula (1), the concentration of all compounds according to formula (1) lies in above-defined ranges.

The pH value of the inventive electroless copper plating bath is not particularly limited. The inventive electroless copper plating bath preferably employs a pH value of 7 or higher, more preferably between 11 and 14, or 12.5 and 14, even more preferably between 12.5 and 13.5, or 12.8 and 13.3.

The inventive electroless copper plating bath optionally comprises a further stabilizing agent (in addition to the compound according to formula (1) which acts as such). The optional further stabilizing agent may further extend the lifetime of the inventive electroless copper plating bath and may help to prevent undesired decomposition thereof. Stabilizing agents are also called stabilizers in the art. Both terms are used interchangeably herein. Reduction of copper (II) should only occur on the desired surface of the substrate and not unspecifically in the plating bath. A stabilizing function can for example be accomplished by substances acting as catalyst poison (for example sulfur or other chalcogenide containing compounds) or by compounds forming copper(I)-complexes, thus inhibiting the formation of copper(I)oxide. Preferable further stabilizing agents are selected from the group consisting of dipyridyls (2,2'-dipyridyl, 4,4'-dipyridyl); phenanthroline; benzotriazole; mercaptobenzothiazole; thiols such as dithiothreitol; thioethers such as 2,2-thiodiethanol; thiourea or its derivatives like diethylthiourea; cyanides like NaCN, KCN; ferrocyanides such as $K_4[Fe(CN)_6]$; thiocyanates; selenocyanates; iodides; ethanolamines; mercaptobenzotriazole; sulfite salts such as $Na_2S_2O_3$; polymers like polyacrylamides, polyacrylates, polyethylene glycols, polypropylene glycols and their copolymers; and mixtures of the aforementioned. In addition, molecular oxygen is often used as a stabilizing agent additive by passing a steady stream of air through the copper electrolyte (ASM Handbook, Vol. 5: Surface Engineering, pp. 311-312). In one embodiment, the stabilizing agent is chosen, mainly for environmental and occupational health reasons, from a further stabilizing agent that is free of cyanides. Thus, the inventive electroless copper plating bath is preferably free of cyanides. Suitable optional stabilizing agents are known in the art and can be found for example in WO 2014/154702 A1 (page 8, line 30 to page 9, line 14) and EP 3 034 650 B1 (paragraphs 39 and 40) which are incorporated herein by reference.

In one embodiment of the present invention, the inventive electroless copper plating bath in addition to the above mentioned components comprises further reducible metal ions other than copper ions. The further reducible metal ions other than copper ions are for example nickel ions and cobalt ions. The further reducible metal ions other than copper ions may be provided as (water-soluble) salt or other (water-soluble) compound of such metals suitable to liberate the ions in the liquid medium. Preferred nickel salts are selected from the group consisting of nickel chloride, nickel sulfate, nickel acetate, nickel methanesulfonate and nickel carbonate. Preferred cobalt salts are selected from the group consisting of cobalt chloride, cobalt sulfate and their respective hydrates. In case further reducible metal ions other than copper ions are comprised in the inventive electroless copper plating bath, a secondary alloy (or of higher order) of copper and the further metal is obtained in the plating process. Such secondary alloys are for example a copper-nickel alloy or a copper-cobalt alloy. The reducing agent suitable for reducing copper ions to metallic copper is usually also capable of reducing the further reducible metal ions other than copper ions to their respective metallic state. If need be, the person skilled in the art can select suitable agents by routine experiments.

The concentration of the further reducible metal ions other than copper ions in the inventive electroless copper plating bath preferably ranges from 1 mg/L to 5 g/L, more preferably from 10 mg/L to 2 g/L, even more preferably from 50 mg/L to 1 g/L. In one embodiment of the invention, the concentration of the further reducible metal ions other than copper ions is sufficient to reach a concentration of 0.1 to 2 wt.-% of the further metal other than copper in the deposited copper alloy. In case more than one type of further reducible metal ions other than copper ions is comprised in the inventive electroless copper plating bath, the overall concentration of all types of further reducible metal ions other than copper ions is preferably in above-defined ranges.

The inventive electroless copper plating bath optionally comprises further components, as for example surfactants, wetting agents, grain refining additives and pH buffers. Such further components are for example described in following documents, which are incorporated by reference in their entirety: U.S. Pat. No. 4,617,205 (particularly, see column 6, line 17 to column 7, line 25), U.S. Pat. No. 7,220,296 (particularly, see column 4, line 63 to column 6, line 26), US 2008/0223253 (see in particular paragraphs 0033 and 0038).

In a preferred embodiment of the invention, the electroless copper plating bath comprises a) copper ions;

b) formaldehyde or glyoxylic acid as the at least one reducing agent;

c) one or more of polyamino disuccinic acid; polyamino monosuccinic acid; a mixture of at least one polyamino disuccinic acid and at least one polyamino monosuccinic acid; tartrate; xylitol; a mixture of N,N,N',N'-tetrakis-(2-hydroxypropyl)-ethylenediamine and N'-(2-hydroxyethyl)-ethylenediamine-N,N,N'-triacetic acid; a mixture of N,N,N',N'-tetrakis-(2-hydroxypropyl)-ethylenediamine and ethylenediamine-tetra-acetic acid (EDTA); or salts of any of the aforementioned as the at least one complexing agent;

d) at least one compound according to formula (1);

and, optionally, further reducible metal ions other than copper ions selected from cobalt ions, nickel ions and mixtures thereof.

The inventive electroless copper plating bath is preferably an aqueous solution. The term "aqueous solution" means that the prevailing liquid medium, which is the solvent in the solution, is water. Further liquids, that are miscible with water, as for example alcohols such as C1-C4-alcohols (e.g. methanol, ethanol, iso-propanol, n-propanol, butanol and its regioisomers) and other polar organic liquids, which are miscible with water, may be added. Preferably, at least 90.0 wt.-%, more preferably 99.0 wt.-% or more, of the liquid medium is water for its ecological benign character.

The inventive electroless copper plating bath advantageously offers a sufficiently high plating rate for many industrial purposes. Higher plating rates are desired as they reduce the time required for forming a certain layer thickness yielding inter alia a cost advantage. The required plating rate depends among others on the desired use of the plating bath and the industry in which it is applied. For example, a preferable minimum plating rate in the electronic industry is (approximately) 3 μm/h for (continuous) production of printed circuit boards.

The inventive electroless copper plating bath may be prepared by dissolving all components in the liquid medium or preferably, by mixing the individual parts of the kit-of-parts described hereinafter and optionally diluting it with the liquid medium.

In one aspect of the present invention, the inventive electroless copper plating bath is used to deposit a copper or copper alloy layer on a surface of a substrate.

The inventive method for depositing at least a copper or copper alloy layer on a surface of a substrate comprises the method steps (i) and (ii). The steps are carried out in the given order but not necessarily in immediate succession. Further steps may be included before, between or after the named steps.

In step (i) of the inventive method for depositing at least a copper or copper alloy layer on a surface of a substrate, the substrate with the surface is provided.

Substrates to be used in the context of the present invention are preferably selected from the group consisting of nonconductive substrates, conductive substrates and mixtures of the aforementioned. Nonconductive substrates are for example plastics such as those described hereinafter, glass, silicon substrates such as semiconductor wafers and dielectric substrates such as those made of epoxy resins and epoxy glass composites. Substrates which are used in the electronics industry such as printed circuit boards, chip carriers, IC substrates or circuit carriers and interconnect devices and display devices are more preferably used. Conductive substrates are metallic substrates and in particular copper substrates. Copper substrates can be obtained from various copper manufacturing processes resulting in e.g. rolled annealed copper and copper foils. The substrates may comprise one or more surfaces made of above-described materials or they may consist of the named materials.

The inventive method for depositing at least a copper or copper alloy layer on a surface of a substrate is preferably used for the deposition on (surfaces of) printed circuit boards, chip carriers, IC substrates and semiconductor wafers (also referred to as semiconductor substrates) or circuit carriers and interconnect devices. In particular, the inventive method for depositing a copper or copper alloy layer on a surface of a substrate is used to plate surfaces, trenches, blind micro vias, through hole vias (through holes) and similar structures with copper and alloys thereof on the substrates outlined hereinbefore. The term "through hole vias" or "through holes", as used in the present invention, encompasses all kinds of through hole vias and includes so-called "through silicon vias" in silicon wafers. Trenches, blind micro vias, through hole vias, and comparable structures are summarily denominated as recessed structures herein.

The method for depositing at least a copper or copper alloy layer on a surface of a substrate optionally comprises one or more further steps (i.a):

(i.a) pretreating the substrate.

Preferably, the one or more steps (i.a) are carried out between steps (i) and (ii). Suitable pre-treatment steps are known in the art and exemplary, but not limiting, described hereinafter. It is known to those skilled in the art that substrates sometimes are contaminated with residues from processing, human contact or the environment such as for example grease, oxidation products or wax residues. These residues may be detrimental to the plating. Therefore, commonly one or more pretreatment steps are advantageous in those cases in order to obtain optimal plating results. Suitable pre-treatment steps encompass desmearing, sweller, etching, reducing or cleaning steps. These steps include among others removal of above-described residues with organic solvents, acidic or alkaline aqueous solutions or solutions comprising surfactants, reducing agents and/or oxidation agents or by highly reactive gases (plasma processing). It is also possible within the scope of the present invention to combine the aforementioned steps in order to obtain pretreated substrates. It is also possible to include further rinsing steps before, between or after these pretreatment steps. Sometimes, an etching step is included in the pre-treatment of the substrate to increase its surface area. This is commonly accomplished by treating the substrate with an aqueous solution comprising strong acids like sulfuric acid and/or oxidation agents like hydrogen peroxide or by using strong alkaline media like potassium hydroxide and/or oxidation agents like potassium permanganate.

Nonconductive substrates that are to be contacted with an inventive electroless plating bath, particularly non-metallic surfaces, may further be pretreated by means within the skill in the art (as for example described in U.S. Pat. No. 4,617,205, column 8) to make them (more) receptive or autocatalytic for the deposition of metals or metal alloys. This pretreatment step is referred to as activation. All or selected portions of a surface may be activated. This activation of nonconductive substrates such as glass substrates, silicon substrates and plastic substrates by a catalyzing metal such as copper, silver, gold, palladium, platinum, rhodium, cobalt, ruthenium, iridium, conductive polymers or electrically conductive carbon black, preferably by a catalyzing metal, more preferred by one of palladium, ruthenium and cobalt, is carried out between steps (i) and (ii). This activation with a catalyzing metal normally does not result in a discrete metal layer but in an island-like structure of metallic spots on the surface of the substrate. Within the activation, it is possible to sensitize substrates prior to the deposition of the metal or metal alloy thereon. This may be achieved by the adsorption of a catalyzing metal onto the surface of the substrate.

Plastic substrates often—but not always—require to be treated with an oxidative treatment prior to activation. These methods are also well-known in the art. Examples for such treatment include roughening of the surface of the substrate with acidic or alkaline solutions comprising further oxidations agents such as chromic acid, sulfuric acid, hydrogen peroxide, permanganate, periodate, bismuthate, halogen oxo compounds such chlorite, chlorous, chlorate, perchlorate, the respective salts thereof or the respective bromine and iodine derivatives. Examples for such etching solutions are disclosed for example in EP 2 009 142 B1, EP 1 001 052 A2 and U.S. Pat. No. 4,629,636. The latter also discloses a method of pretreating a plastic surface including an activation step (Examples I and II therein). Plastic substrates in the context of the present invention are preferably selected from the group consisting of acrylonitrile-butadiene-styrene copolymer (ABS copolymer), polyamide (PA), polycarbonate (PC), polyimide (PI), polyethylene terephthalate (PET), liquid-crystal polymers (LCPs), cyclic olefin copolymer (COC), or plastics made for photoimageable dielectrics and mixtures of the aforementioned. More preferably, plastic substrate are selected from the group consisting of polyimide (PI), liquid-crystal polymers (LCPs), cyclic olefin copolymer (COC), polyethylene terephthalate (PET), plastics made for photoimageable dielectrics and mixtures of the aforementioned.

An exemplary and non-limiting pretreatment process, especially for printing circuit board laminates and other suitable substrates, may comprise one or more of the following steps:

α) optionally, cleaning and, optionally, conditioning the substrate to increase adsorption thereof. With a cleaner, organics and other residues are removed. It may also contain additional substances (conditioners) that prepare the surface for the following activation steps, i.e. enhance the adsorption of the catalyst and lead to a more uniformly activated surface;

β) etching the surface of the substrate, to remove oxides therefrom, especially from inner layers in vias. This may be done by persulfate or peroxide based etching solutions;

χ) contacting with a pre-dip solution, such as by an acidic solution (e.g. hydrochloric acid solution or sulfuric acid solution), optionally with an alkali metal salt, such as sodium chloride, or optionally with additional surfactants;

δ) contacting the surface of the substrate with an activator solution that contains colloidal or ionic catalyzing metal rendering the surface of the substrate catalytic for copper or copper alloy deposition. The pre-dip in step χ) serves to protect the activator from drag-in and contaminations, and optionally, albeit preferably, if the activator contains ionic catalyzing metal:

ε) optionally, contacting the surface of the substrate with a reducer, wherein the catalyzing metal ions of an ionic activator are reduced to elemental metal;

or, if the activator contains colloidal catalyzing metal:

ϕ) optionally, contacting the surface of the substrate with an accelerator, wherein components of the colloid, for example a protective colloid, are removed from the catalyzing metal;

γ) optionally, contacting the surface of the substrate with an enhancer consisting of the components that are used as reducing agents in the electroless copper plating bath.

In step (ii) of the inventive method for depositing at least a copper or copper alloy layer on a surface of a substrate, at least a portion of the surface of the substrate is contacted with the inventive electroless copper plating bath; and thereby a copper or copper alloy layer is deposited onto the at least one portion of the surface of the substrate.

The inventive electroless copper plating bath is preferably held at a temperature ranging from 20 to 80° C., more preferably from 25 to 60° C. and even more preferably from 28 to 45° C. during step (ii).

The substrate is preferably contacted with the inventive electroless copper plating bath for a plating time of 0.5 to 30 min, more preferably 1 to 25 min and even more preferably 2 to 20 min during step (ii).

The substrate or at least a portion of its surface may be contacted with the electroless plating bath according to the invention. This contact may be accomplished by means of spraying, wiping, dipping, immersing or by other suitable means. In case copper or copper alloy is deposited into recessed structures of substrates such as printed circuit board, IC substrates or the semiconductor substrates one or more circuitries made of copper or copper alloy are obtained. If the surface of the substrate comprises or consists of a conductive material, it is preferential to apply a negative electrical potential in the beginning of the step (ii) for improved initiation of the plating process.

It is preferential to agitate the inventive electroless copper plating bath during the plating process, i.e. the deposition of the copper or copper alloy layer. Agitation may be accomplished for example by mechanical movement of the inventive electroless plating bath like shaking, stirring or continuously pumping of the liquids or by ultrasonic treatment, elevated temperatures or gas feeds (such as purging the electroless plating bath with air or an inert gas such as argon or nitrogen).

The inventive method for depositing at least a copper or copper alloy layer on a surface of a substrate optionally comprises further cleaning, etching, reducing, rinsing and/or drying steps all of which are known in the art. Suitable methods for the cleaning, reducing and etching depend on the substrate to be used and have been described above for the optional pretreatment step (i.a). Drying of the substrate may be accomplished by subjecting the substrate to elevated temperatures and/or reduced pressure and/or gas flows.

Step (ii) in the inventive method for depositing at least a copper or copper alloy layer on a surface of a substrate can be performed inter alia using horizontal, reel-to-reel, vertical and vertically conveyorized plating equipment. A particularly suitable plating tool which can be used to carry out the process according to the present invention is disclosed in US 2012/0213914 A1.

It is preferred to comprise a further method step (iii) after method step (ii), which is defined as follows:

(iii) depositing a copper or copper alloy layer from an electrolytic copper plating bath.

Electrolytic copper plating baths for this purpose are well known in the art. They usually comprise copper ions, an electrolyte (typically a strong acid such as sulfuric acid, fluoroboric acid or methanesulfonic acid), chloride ions, optionally one or more leveller, optionally one or more brightener and optionally one or more carrier. These compounds are known in the art and are disclosed for example in WO 2017/037040 A1 (page 21, line 1 to page 22, line 27). The electrolytic copper plating is then carried out (directly) on top of the copper or copper alloy layer formed in step (ii). Thus, a copper or copper alloy layer is formed electrolytically (directly) on the electrolessly deposited copper or copper alloy layer (in step (ii)). In one embodiment of the invention, the electrolytic copper or copper alloy layer is formed directly on the electrolessly deposited copper or copper alloy layer.

It is particularly advantageous to include step (iii) in the method for depositing at least a copper or copper alloy layer on a surface of a substrate if thicker deposits are desired as optional step (iii) allows obtaining thicker copper or copper alloy layers in a shorter period of time compared to a mere electroless deposition processes. This step is thus consequently referred to herein and in the art as "electrolytic thickening".

In one embodiment of the invention, the method for depositing at least a copper or copper alloy layer on a surface of a substrate comprises, in this order, the method steps:

(i) providing the substrate with the surface;

(i.a) optionally, pretreating the substrate;

(ii) contacting at least a portion of the surface of the substrate with the inventive electroless copper plating bath to deposit an electroless copper or copper alloy layer on the surface of the substrate; and (iii) depositing a further copper or copper alloy layer from an electrolytic copper plating bath to deposit a electrolytic copper or copper alloy layer (directly) on the electroless copper or copper alloy layer.

The present invention concerns in a further aspect the copper or copper alloy layers obtained from the inventive electroless copper plating bath. The thus obtained copper or copper alloy layers preferably have a thickness ranging from 10 nm to 5 μm, more preferably from 100 nm to 3 μm, even more preferably from 150 nm to 2.5 μm.

The copper or copper alloy layers formed with the inventive method for depositing at least a copper or copper alloy layer on a surface of a substrate and from the inventive electroless copper plating bath show various advantages over the solutions known from the prior art:

- the copper or copper alloy layers are very glossy and exhibit high optical reflectivity, in particular after electrolytic thickening;
- the copper or copper alloy layers are very smooth, in particular after electrolytic thickening;
- the inventors of the present invention found that the smoothness and the gloss of an subsequently deposited copper or copper alloy layer from an electrolytic plating process depends to a large amount on the properties of the underlying substrate, i.e. in the present case of the copper or copper alloy layer formed from the inventive electroless copper plating bath. Thus, the present invention allows for improved smoothness and gloss also of subsequently deposited copper or copper alloy layer from an electrolytic plating processes.

The inventors attributed above described advantages to the fact that the copper or copper alloy layers obtained from the inventive electroless copper plating bath typically comprise the at least one compound according to formula (1). Typically, the amount of said compound is sufficient to reach above-outlined advantages.

In one embodiment of the invention, the present invention concerns a layer system comprising:

- a substrate having a surface;
- a copper or copper alloy layer deposited from the inventive electroless copper plating bath on the surface of the substrate.

In a preferred embodiment, the present invention concerns a layer system comprising:

- a substrate having a surface;
- a copper or copper alloy layer deposited from the inventive electroless copper plating bath on the surface of the substrate; and a copper or copper alloy layer deposited from an electrolytic copper plating bath on the top of said copper or copper alloy layer deposited from the electroless copper plating bath.

The combined layer thickness of the layers formed from the inventive electroless copper plating bath (step (ii) of the method for depositing at least a copper or copper alloy layer on a surface of a substrate) and an electrolytic copper plating bath (step (iii) of the method for depositing at least a copper or copper alloy layer on a surface of a substrate) preferably ranges from 2 μm to 80 μm, more preferably from 5 μm to 40 μm, even more preferably from 5 μm to 25 μm.

In a further aspect, the present invention concerns a method for stabilizing an (conventional) electroless copper plating bath comprising copper ions, at least one reducing agent suitable to reduce copper ions to metallic copper and at least one complexing agent for copper ions, comprising, in this order, the method steps:

I) providing the electroless copper plating bath; and

II) adding at least one compound according to formula (1):

(1)

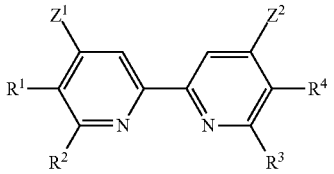

wherein $Z^1$ and $Z^2$ are independently selected from the group consisting of hydrogen; carboxylic acid group; carboxylate group; sulfonic acid group; sulfonate group; substituted or non-substituted carboxamide group; nitrile group; nitro group; substituted or non-substituted trialkylammonium group; substituted or non-substituted 2-carboxyvinyl group; substituted or non-substituted 2-vinylcarboxylate group; substituted or non-substituted 2-(trialkylammonium)vinyl group; substituted or non-substituted hydroxamic acid group; and substituted or non-substituted oxime group;

with the proviso that at least one of $Z^1$ and $Z^2$ is not hydrogen;

and wherein $R^1$, $R^2$, $R^3$ and $R^4$ are defined as follows:

i. $R^1$, $R^2$, $R^3$ and $R^4$ are hydrogen; or ii. $R^1$ with $R^2$ are forming together a substituted or non-substituted aromatic ring moiety, $R^3$ and $R^4$ are hydrogen; or iii. $R^3$ with $R^4$ are forming together a substituted or non-substituted aromatic ring moiety, $R^1$ and $R^2$ are hydrogen; or iv. $R^1$ with $R^2$ as well as $R^3$ with $R^4$ are forming together a substituted or non-substituted aromatic ring moiety, respectively.

The steps are carried out in the given order but not necessarily in immediate succession. Further steps may be included before, between or after the named steps.

In step I) of the method for stabilizing an (conventional) electroless copper plating bath, the electroless copper plating bath comprising copper ions, at least one reducing agent suitable to reduce copper ions to metallic copper and at least one complexing agent for copper ions is provided. This bath can be any known conventional plating bath. A conventional electroless copper plating bath is a bath comprising the said components but which does not comprise the at least one compound according to formula (1).

In step II) of the method for stabilizing an (conventional) electroless copper plating bath, at least one compound according to formula (1) is added to said bath. By adding the compound according to formula (1) to the (conventional) electroless copper plating bath, said bath is stabilized. Thus, among other benefits, its lifetime is improved and the risk of plate-out is reduced. A conventional electroless copper plating bath which is improved by the method for stabilizing an electroless copper plating bath enjoys the advantages and benefits of an inventive electroless copper plating bath outlined in this specification. The thus obtained stabilized electroless copper plating bath may be used in the inventive method for depositing a copper or copper alloy layer on a surface of a substrate.

Preferred embodiments and details described hereinbefore apply mutatis mutandis to the method for stabilizing an (conventional) electroless copper plating bath. Thus, in one aspect of the present invention, the at least one compound according to formula (1) can be used as stabilizing agent in a (conventional) electroless copper plating bath.

In a further aspect, the present invention concerns a kit-of-parts for providing the inventive electroless copper plating bath, comprising the following parts A) to D):

A) a solution, preferably an aqueous solution, comprising the copper ions;

B) a solution, preferably an aqueous solution, comprising the at least one reducing agent suitable to reduce copper ions to metallic copper;

C) a solution, preferably an aqueous solution, comprising the at least one complexing agent for copper ions; and D) a solution, preferably an aqueous solution, comprising the at least one compound according to formula (1):

(1)

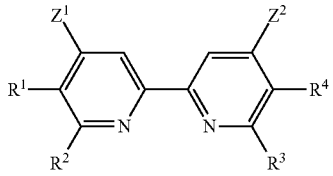

wherein $Z^1$ and $Z^2$ are independently selected from the group consisting of hydrogen; carboxylic acid group; carboxylate group; sulfonic acid group; sulfonate group; substituted or non-substituted carboxamide group; nitrile group; nitro group; substituted or non-substituted trialkylammonium group; substituted or non-substituted 2-carboxyvinyl group; substituted or non-substituted 2-vinylcarboxylate group; substituted or non-substituted 2-(trialkylammonium)vinyl group; substituted or non-substituted hydroxamic acid group; and substituted or non-substituted oxime group;

with the proviso that at least one of $Z^1$ and $Z^2$ is not hydrogen;

and wherein $R^1$, $R^2$, $R^3$ and $R^4$ are defined as follows:

i. $R^1$, $R^2$, $R^3$ and $R^4$ are hydrogen; or ii. $R^1$ with $R^2$ are forming together a substituted or non-substituted aromatic ring moiety, $R^3$ and $R^4$ are hydrogen; or iii. $R^3$ with $R^4$ are forming together a substituted or non-substituted aromatic ring moiety, $R^1$ and $R^2$ are hydrogen; or iv. $R^1$ with $R^2$ as well as $R^3$ with $R^4$ are forming together a substituted or non-substituted aromatic ring moiety, respectively.

The inventive kit-of-parts can be used to formulate the inventive electroless copper plating bath, e.g. by mixing the parts A) to D). To this end, the parts A) to D) are mixed in any suitable ratio. It is thus possible because of dilution effects that the concentrations in the individual parts of the inventive kit-of-parts may deviate from those described for the preferred embodiments of the inventive electroless copper plating bath. The solutions of the parts A) to D) are preferably aqueous solutions for the reasons laid out above. The term "aqueous solution" for the parts of the inventive kit-of-parts means the same as for the inventive electroless copper plating bath.

In one embodiment of the invention, one or more of the individual parts of the inventive kit-of-parts further comprises components such as those described hereinbefore and/or the inventive kit-of-parts optionally comprises further parts such as aqueous solutions comprising such components.

In a preferred embodiment of the invention, the inventive kit-of-parts for providing the inventive electroless copper plating bath, comprises the following parts A) to D):

A) an aqueous solution comprising the copper ions in a concentration ranging from 1 g/L to 470 g/L, preferably from 10 g/L to 250 g/L, more preferably from 20 g/L to 80 g/L;

B) an aqueous solution comprising the at least one reducing agent suitable to reduce copper ions to metallic copper in a concentration ranging from 50 g/L to 600 g/L, preferably from 100 g/L to 450 g/L, more preferably from 100 g/L to 400 g/L;

C) an aqueous solution comprising the at least one complexing agent for copper ions in a concentration ranging from 0.18 mol/L to 2.9 mol/L, preferably from 0.3 mol/L to 2.0 mol/L, more preferably from 0.7 mol/L to 1.5 mol/L; and D) an aqueous solution comprising the at least one compound according to formula (1) in a concentration ranging from 0.01 g/L to 150 g/L, preferably from 0.05 g/L to 50 g/L, more preferably from 0.1 g/L to 25 g/L.

Preferred embodiments and details described hereinbefore apply mutatis mutandis to the inventive kit-of-parts with the exception of the preferred concentration for the reasons laid out above.

It is one advantage of the inventive kit-of-parts that the preparation of the inventive electroless copper plating bath is facilitated. The handling of (aqueous) solutions is much easier and safer compared to pure chemicals (lower concentrations, no dust when handling powders and so forth). Further, the lifetime of the individual parts of the inventive kit-of-parts is much higher than the lifetime of the inventive electroless copper plating bath because components which may react with each other such as the reducing agent and the copper ions are not yet in contact with each other.

It is also possible to further dilute the individual parts of the inventive kit-of-parts before or after mixing them to prepare the inventive electroless copper plating bath with the liquid medium, preferably with water.

Another advantage of the present invention is an improved coverage of the surface of the substrate with copper compared to electroless copper plating baths known from the prior art. This is measureable by the so-called backlight test.

It is another distinct advantage of the present invention that copper or copper alloy layers can be deposited on flexible materials such as glass fibers and polyimide foils and adhere well to those materials without any substantial delamination risk.

INDUSTRIAL APPLICABILITY

The present invention is particularly useful in the electronic industry and can be used in the manufacturing of printed circuit boards and integrated circuit (IC) substrates.

EXAMPLES

The invention will now be illustrated by reference to the following non-limiting examples.

Commercial products were used as described in the technical datasheet available on the date of filing of this specification unless stated otherwise hereinafter. Securiganth® 902 Cleaner ULS, pH Correction Solution, Neoganth® B PreDip, Neoganth® U Activator, Neoganth® Reducer P-WA, Cuparacid® AC Leveller and Cuparacid® AC Brightener are products produced and distributed by Atotech Deutschland GmbH. These products were used according to the specification in the technical datasheets available at the date of filing unless stated otherwise herein.

Substrates

For deposition tests, bare-laminate FR-4 substrates (MC10EX from Panasonic) were used. For evaluation of the through-hole coverage, coupons based on the materials IS410 (from Isola), 158TC (from ITEQ), R-1755C (from Matsushita/Panasonic), NP140 (from Nan Ya), S1141 (from Shengy) were utilized. The hole diameter in the coupons was 1 mm. If necessary, the substrates were subjected to a desmear treatment which is known in the art. For gloss measurements laminates with epoxy resin core material and with rolled and annealed (RA-Cu) or hot annealed (HA-Cu, BH-HA-Cu) copper were used. The gloss (also referred to as shininess) of the surface was evaluated by a full color 300×300 dpi scan with a Canon C5535i, importing the image to an appropriate image analysis tool (e.g. Olympus Stream Enterprise) and analyzing the scan by using a region of interest (ROI) tool with adjusting of the channels red 0-150, green 0-128, blue 0-128.

Backlight Method: Investigation of Copper or Copper Alloy Layer Coverages of Surfaces in Recessed Structures The coverage of the surfaces of recessed structures with copper or copper alloy in the method can be assessed using an industry standard Backlight Test, in which a plated coupon is sectioned, so as to allow areas of incomplete coverage to be detected as bright spots when viewed over a strong light source [confer US 2008/0038450 A1, incorporated herein by reference in its entirety]. The quality of the copper or copper alloy deposit is determined by the amount of light that is observed under a conventional optical microscope.

The results of the backlight measurement are given on a scale from D1 to D10, wherein D1 means the worst result and D10 the best result. Reference samples showing results from D1 to D10 are shown in FIG. 3 of WO 2013/050332 A1 (incorporated herein by reference).

Copper or Copper Alloy Layer Thickness Measurement

The deposit thickness was measured at 10 copper pads on each side of the test panels. The chosen copper pads had different sizes and are used to determine the layer thickness by XRF using the XRF instrument Fischerscope X-RAY XDV-μ (Helmut Fischer GmbH, Germany). By assuming a layered structure of the deposit, the layer thickness can be calculated from such XRF data. The plating rate was calculated by dividing the obtained layer thickness by the time necessary to obtain said layer thickness.

Deposition of Copper on the Substrates

Prior to depositing copper on the surface of the substrates, the substrates were pretreated as described in Table 1 (step (i.a)).

TABLE 1

Pretreatment steps of substrates before plating.

| Process Steps | Compounds/Products | concentration | Temperature [° C.] | Time [s] |
|---|---|---|---|---|
| Cleaning step | Securiganth 902 Cleaner ULS | 40 mL/L | 45 | 60 |
| | pH Correction Solution | 50 mL/L | | |
| Etching step | Sodium persulfate | 150 g/L | 30 | 60 |
| | 50 wt.-% $H_2SO_4$ (aq.) | 35 mL/L | | |
| Pre Dip step | Neoganth B PreDip | 10 mL/L | 40 | 20 |
| Ionic Activation | Neoganth U Activator | 225 mL/L | 45 | 35 |
| | pH Correction Solution pH value adjusted to 10 | 1 mL/L | | |
| Reduction step | Neoganth Reducer P-WA | 3 mL/L | 35 | 35 |

Then, electroless copper plating baths were prepared by dissolving the following components in water having each a final volume of 0.450 $dm^3$ after preparation:

copper sulfate as the copper ion source (1.91 g copper ions), tartrate as the complexing agent for copper ions (20.3 g), NaOH and sulfuric acid as pH adjustors to adjust the pH to 13, formaldehyde as the reducing agent suitable for reducing copper ions to metallic copper (2.12 g) and a 0.115 wt.-% solution of compound according to formula (1) in amounts given below wherein $Z^1$ and $Z^2$ each were potassium salts of $CO_2H$ and wherein $R^1$, $R^2$, $R^3$ and $R^4$ are hydrogen (1 mL to 20 mL). The latter compound is referred to hereinafter as "compound A".

The substrates were immersed into the electroless copper plating baths for 360 s. The electroless copper plating bath had a temperature of 34° C. while plating (step (ii)).

And finally, the substrates were subjected to a step of electrolytic copper deposition (electrolytic thickening) using a copper plating bath comprising $CuSO_4 \times 5\ H_2O$ (86 g/L), 98 wt.-% $H_2SO_4$ (aq., 245 g/L), NaCl (100 mg/L), Cuparacid AC Leveller (15 mL/L) and Cuparacid AC Brightener (4.5 mL/L). The deposition was run at 20° C. employing 0.5 A for 900 s under air injection (step (iii)).

As comparative examples, electroless copper plating baths with no compound according to formula (1), electroless copper plating baths with 2,2-bipyridine and 4,4-dimethyl-2,2-bipyridine, respectively, in concentrations given below were used. The results are summarized in the following tables:

TABLE 2

Plating rate of the electroless copper deposition.

| Entry | volume additive solution [mL] | plating rate [μm/0.1 h] |
|---|---|---|
| 1 | 0 mL* | 0.54 |
| 2 | 1 mL compound A | 0.55 |
| 3 | 5 mL compound A | 0.48 |
| 4 | 10 mL compound A | 0.65 |
| 5 | 20 mL compound A | 0.70 |
| 6 | 11 mL 2,2-bipyridine*[b] | 0.36 |
| 7 | 5 mL 4,4-dimethyl-2,2-bipyridine*[c] | 0.31 |

*comparative example;
[b]concentration of 2,2-bipyridine in plating bath comparable to Entry 4;
[c]a 0.115 wt.-% solution of 4,4-dimethyl-2,2-bipyridine was used.

The copper or copper alloy layers obtained from the inventive electroless copper plating baths after electrolytic copper enforcement were very glossy and showed superior gloss compared to the copper or copper alloy layers obtained from the comparative plating baths (see Table 3). Also in these cases the inventive copper layer system allowed for superior gloss values to be obtained compared to the comparative ones. The comparative electroless copper plating bath without any stabilizing agent quickly showed a significant amount of plate-out rendering such baths useless for commercial purposes. The plating rate of the inventive examples was also very high compared to the comparative examples with stabilizing agent.

TABLE 3

Quantification of shininess.

| # | volume additive solution | RA-Cu | HA-Cu | BH-HA-Cu |
|---|---|---|---|---|
| 1 | 0 mL* | 98% | 71% | 85% |
| 2 | 1 mL compound A | 99% | 65% | 84% |
| 3 | 5 mL compound A | 97% | 68% | 77% |
| 4 | 10 mL compound A | 94% | 58% | 91% |
| 5 | 20 mL compound A | 63% | 59% | 86% |
| 6 | 11 mL 2,2-bipyridine*[b] | 58% | 17% | 66% |
| 7 | 5 mL 4,4-dimethyl-2,2-bipyridine*[c] | 30% | — | |
| 8 | 10 mL 4,4-dimethyl-2,2-bipyridine*[c] | 29% | — | |

*comparative example;
[b]concentration of 2,2-bipyridine in plating bath comparable to Entry 4;
[c]a 0.115 wt.-% solution of 4,4-dimethyl-2,2-bipyridine was used The inventive electroless copper plating baths comprising the compound according to formula (1) allowed for much greater gloss than the comparative plating baths with stabilizing agents. Also, this was achievable over much broader applied current density in step (iii).

TABLE 4

Backlight tests.

| | volume additive solution [mL] | NP140 (Nan Ya) | IS 410 (Isola) | R-1755C (Matsushita) |
|---|---|---|---|---|
| 1 | 20 mL compound A | D7.5 | D9.5 | D8.5 |
| 2 | 11 mL 2,2-bipyridine* | D7 | D5.5 | D6.5 |

*comparative example

After the electroless deposition, the backlight tests were carried out. It is obvious that the inventive electroless copper plating bath allowed for an improved coverage compared to the plating bath which comprised 2,2-bipyridine and 4,4-dimethyl-2,2-bipyridine instead of the compound according to formula (1).

In summary, only the inventive examples showed a sufficiently high plating rate and stability of the bath as well as high gloss and coverage of the deposits. Other embodiments of the present invention will be apparent to those skilled in the art from a consideration of this specification or practice of the invention disclosed herein. It is intended that the specification and examples be considered as exemplary only, with the true scope of the invention being defined by the following claims only.

The invention claimed is:

1. An electroless copper plating bath for depositing a copper or copper alloy layer on a surface of a substrate, comprising a) copper ions;

b) at least one reducing agent suitable for reducing copper ions to metallic copper; and c) at least one complexing agent for copper ions;

characterized in that the electroless copper plating bath comprises d) at least one compound according to formula (1):

(1)

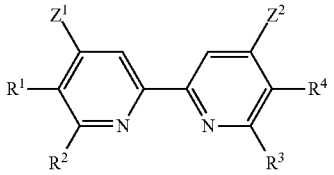

wherein $Z^1$ and $Z^2$ are independently selected from the group consisting of hydrogen; carboxylic acid group; carboxylate group; sulfonic acid group; sulfonate group; substituted or non-substituted carboxamide group; nitrile group; nitro group; substituted or non-substituted trialkylammonium group; substituted or non-substituted 2-carboxyvinyl group; substituted or non-substituted 2-vinylcarboxylate group; substituted or non-substituted 2-(trialkylammonium)vinyl group; substituted or non-substituted hydroxamic acid group; and substituted or non-substituted oxime group;

with the proviso that at least one of $Z^1$ and $Z^2$ is not hydrogen;

and wherein $R^1$, $R^2$, $R^3$ and $R^4$ are defined as follows:

i. $R^1$, $R^2$, $R^3$ and $R^4$ are hydrogen; or ii. $R^1$ with $R^2$ are forming together a substituted or non-substituted aromatic ring moiety, $R^3$ and $R^4$ are hydrogen; or iii. $R^3$ with $R^4$ are forming together a substituted or non-substituted aromatic ring moiety, $R^1$ and $R^2$ are hydrogen; or iv. $R^1$ with $R^2$ as well as $R^3$ with $R^4$ are forming together a substituted or non-substituted aromatic ring moiety, respectively, wherein the electroless copper plating bath has a pH in the range from 12.5 to 14.

2. The electroless copper plating bath according to claim 1 wherein $Z^1$ and $Z^2$ are independently selected from the group consisting of hydrogen; carboxylic acid group; carboxylate group; sulfonic acid group; sulfonate group;

nitrile group; nitro group; substituted or non-substituted trialkylammonium group;

substituted or non-substituted 2-carboxyvinyl group; and substituted or non-substituted 2-(trialkylammonium) vinyl group.

3. The electroless copper plating bath according to claim 2 wherein $Z^1$ and $Z^2$ are independently selected from the group consisting of hydrogen; carboxylic acid group; carboxylate group; sulfonic acid group; sulfonate group; substituted or non-substituted trialkylammonium group; substituted or non-substituted 2-carboxyvinyl group; and substituted or non-substituted 2-(trialkylammonium)vinyl group.

4. The electroless copper plating bath according to claim 3 wherein $Z^1$ and $Z^2$ are independently selected from the group consisting of hydrogen; carboxylic acid group; carboxylate group; sulfonic acid group; and sulfonate group.

5. The electroless copper plating bath according to claim 4 wherein $Z^1$ and $Z^2$ are independently selected from the group consisting of hydrogen, carboxylic acid group and carboxylate group.

6. The electroless copper plating bath according to claim 1 wherein $Z^1$ and $Z^2$ are the same.

7. The electroless copper plating bath according to claim 1 wherein neither $Z^1$ nor $Z^2$ is hydrogen.

8. The electroless copper plating bath according to claim 1 wherein $R^1$, $R^2$, $R^3$ and $R^4$ are hydrogen.

9. The electroless copper plating bath according to claim 1 wherein the concentration of the at least one compound according to formula (1) ranges from $1.0*10^{-6}$ mol/L to $5.0*10^{-3}$ mol/L.

10. The electroless copper plating bath according to claim 9 wherein the concentration of the at least one compound according to formula (1) ranges from $4.0*10^{-6}$ mol/L to $4*10^{-3}$ mol/L.

11. The electroless copper plating bath according to claim 10 wherein the concentration of the at least one compound according to formula (1) ranges from $2.0*10^{-5}$ mol/L to $6.5*10^{-4}$ mol/L.

12. A method for depositing at least a copper or copper alloy layer on a surface of a substrate, comprising, in this order, the method steps:

(i) providing the substrate with the surface;

(ii) contacting at least a portion of the surface of the substrate with the electroless copper plating bath according to claim 1;

and thereby depositing a copper or copper alloy layer onto the at least one portion of the surface of the substrate.

13. A method for depositing at least a copper or copper alloy layer on a surface of a substrate according to claim 12, wherein a further method step (iii) is comprised after method step (ii), which is defined as follows:

(iii) depositing a copper or copper alloy layer from an electrolytic copper plating bath.

14. A kit-of-parts for providing the electroless copper plating bath of claim 1, comprising the following parts A) to D):

A) a solution comprising the copper ions;

B) a solution comprising the at least one reducing agent suitable to reduce copper ions to metallic copper;

C) a solution comprising the at least one complexing agent for copper ions; and v. D) a solution comprising the at least one compound according to the formula (1), wherein the electroless copper plating bath prepared from the parts A) to D) has a pH in the range from 12.5 to 14.

* * * * *